US006890216B2

(12) United States Patent
Matsunaga et al.

(10) Patent No.: US 6,890,216 B2
(45) Date of Patent: May 10, 2005

(54) CONNECTOR WHICH CAN BE SIMPLIFIED IN STRUCTURE OF AN END PORTION IN A CARD INSERTING/REMOVING DIRECTION

(75) Inventors: Akihiro Matsunaga, Tachikawa (JP); Keiichiro Suzuki, Kodaira (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/426,292

(22) Filed: Apr. 30, 2003

(65) Prior Publication Data

US 2003/0211783 A1 Nov. 13, 2003

(30) Foreign Application Priority Data

May 10, 2002 (JP) ..... 2002-136152

(51) Int. Cl.[7] ..... H01R 23/70
(52) U.S. Cl. ..... 439/630
(58) Field of Search ..... 439/630, 736, 439/188

(56) References Cited

U.S. PATENT DOCUMENTS 6,375,482 B1 * 4/2002 Fan ..... 439/188
6,454,607 B2 * 9/2002 Bricaud ..... 439/630
6,576,853 B2 * 6/2003 Motojima ..... 200/51.09
6,602,096 B1 * 8/2003 Kronestedt et al. ..... 439/630
6,663,408 B2 * 12/2003 Sato ..... 439/331

FOREIGN PATENT DOCUMENTS

| | | |
|---|---|---|
| JP | 10-335010 | 12/1998 |
| JP | 11-195466 | 7/1999 |
| JP | 2001-185264 | 7/2001 |
| JP | 2001-237010 | 8/2001 |
| JP | 2001-313107 | 11/2001 |

* cited by examiner

*Primary Examiner*—Thanh-Tam Le
(74) *Attorney, Agent, or Firm*—Collard & Roe, P.C.

(57) ABSTRACT

A conductive contact (1) is coupled to an insulator (7) for receiving a first object to be movable in a first direction (X). The contact has a frame portion (1*c*) which defines an opening (1*e*) extending in the first direction and a second direction (Y) perpendicular to the first direction and which is fixed to the insulator. A spring portion (1*b*) extends from the frame portion to face the opening in a third direction (Z) perpendicular to the first and the second directions. The spring portion has a contacting portion (1*a*) to be brought into contact with the first object. A terminal portion (1*d*) extends outward from the frame portion to be brought into contact with a second object. The terminal portion has a portion extending in the second direction and exposed from the insulator.

18 Claims, 4 Drawing Sheets

CONNECTOR WHICH CAN BE SIMPLIFIED IN STRUCTURE OF AN END PORTION IN A CARD INSERTING/REMOVING DIRECTION

This application claims priority to prior patent application JP 2001-136152, the disclosure of which is incorporated herein by reference.

BACKGROUND OF THE INVENTION

The present invention relates to a connector and, in particular, to a connector for connection of an object such as an IC card.

For example, a connector of the type is disclosed in Japanese Unexamined Patent Publication No. 2001-237010 (JP 2001-237010 A) as a "card connector". The card connector comprises a base member for receiving a card and a plurality of contact members fitted to the base member. Each of the contact members has a contacting portion exposed on an upper surface of the base member and a bonding portion integrally connected to the contacting portion and extending outward from an end face of the base member in a first direction. The bonding portion is connected to a printed board by soldering. The card is inserted into and removed from the card connector in the first direction. When the card is mounted at a predetermined position of the base member, the card is brought into contact with the contacting portions. As a consequence, the card is electrically connected to the printed board through the contact members.

In the card connector, the contact members have bonding portions extending outward from the base member in the first direction. Because of presence of the bonding portions and areas used in bonding or soldering the bonding portions, it is therefore difficult to provide, in the vicinity of the base member, guiding means for guiding the card to be inserted and removed. Without the guiding means, the card may be engaged with the base member to cause a damage in the card or the card connector when it is inserted.

SUMMARY OF THE INVENTION

It is therefore an object of the present invention to provide a connector which can be simplified in structure of an end portion in an inserting/removing direction of an object to be connected.

It is another object of the present invention to provide a connector which makes it easy to provide, in the vicinity of an end portion in an inserting/removing direction, means for guiding an object to be inserted and removed.

It is still another object of the present invention to provide a connector excellent in reliability of contact.

Other objects of the present invention will become clear as the description proceeds.

According to an aspect of the present invention, there is provided a connector comprising an insulator for receiving a first object to be movable in a first direction and a conductive contact coupled to the insulator, the conductive contact comprising a frame portion fixed to the insulator and defining an opening extending in the first direction and a second direction perpendicular to the first direction, a spring portion extending from the frame portion to face the opening in a third direction perpendicular to the first and the second directions, a contacting portion connected to the spring portion for contacting with sad first object, and a terminal portion extending from the frame portion to an outside of the frame portion for contacting with a second object, the terminal portion having a part which extends in the second direction and is exposed outward from the insulator.

According to another aspect of this invention, there is provided a connector comprising an insulator for receiving a first object to be removable in a first direction and six conductive contacts coupled to the insulator, each of the conductive contacts comprising a frame portion fixed to the insulator and defining an opening extending in the first direction and a second direction perpendicular to the first direction, a spring portion extending from the frame portion to face the opening in a third direction perpendicular to the first and the second directions, a contacting portion connected to the spring portion for contacting with the first object, and a terminal portion extending from the frame portion to an outside of the frame portion for contacting with a second object, the terminal portion having a part which extends in the second direction and exposed outward from the insulator.

DESCRIPTION OF THE PREFERRED EMBODIMENTS

Referring to FIGS. 1 to 4, description will be made of a connector according to an embodiment of the present invention.

Figure 1:
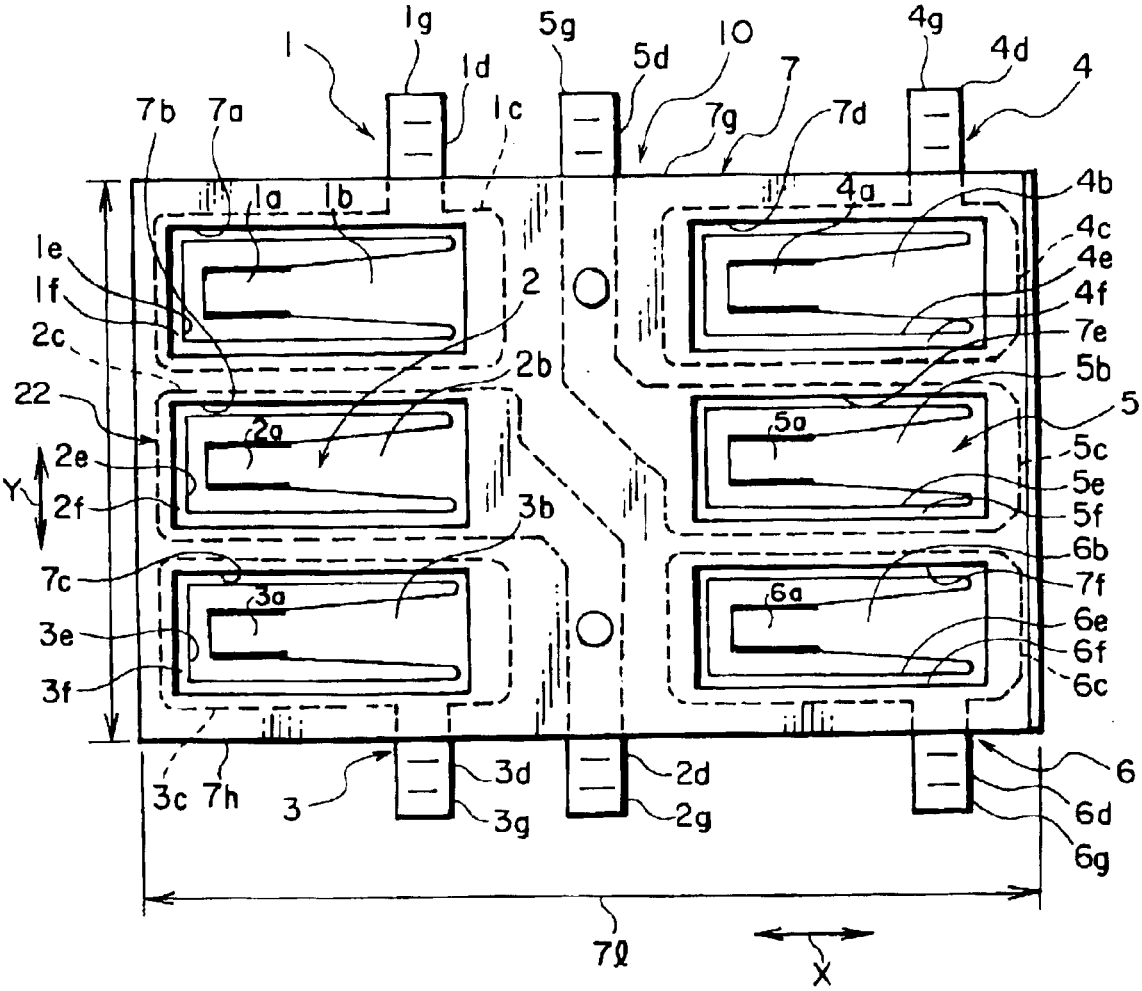
FIG. 1 is a plan view of a connector according to an embodiment of the present invention.
Figure 2:
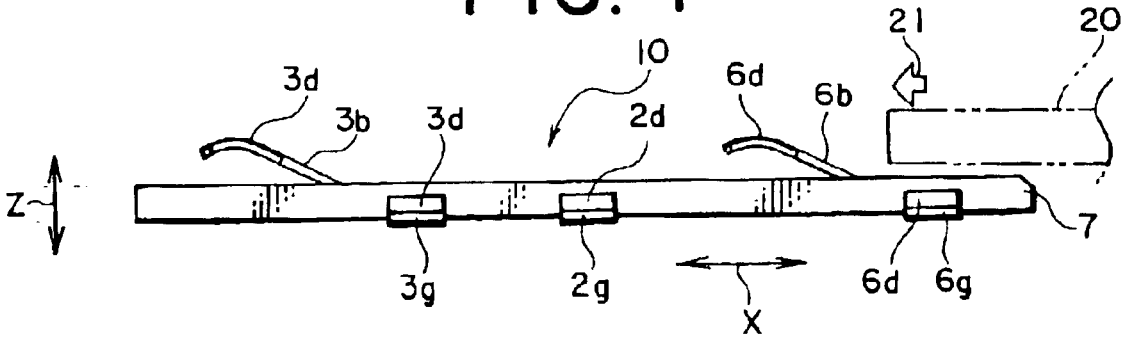
FIG. 2 is a side view of the connector illustrated in FIG. 1.
Figure 3:
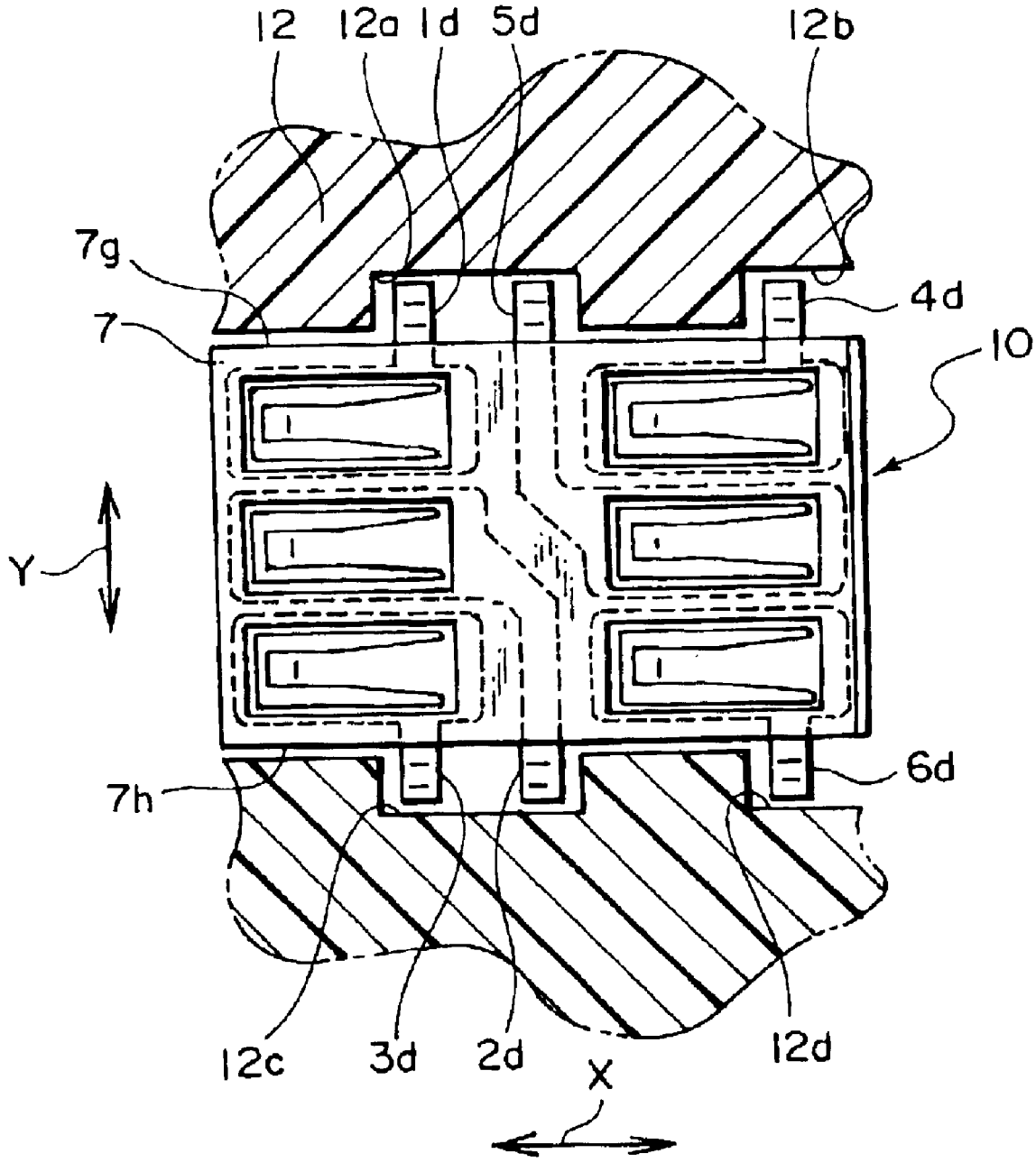
FIG. 3 is a sectional plan view showing the connector in FIG. 1 when it is received in a housing.

Referring to FIG. 1, the connector is designated by reference symbol 10 and serves to connect an IC card 20 as a first object to a printed circuit board 13 as a second object. The connector 10 will hereinafter be called a card connector. The IC card 20 is inserted into and removed from the connector 10 in a first direction X which may be referred as a card inserting/removing direction.

The card connector 10 comprises six conductive contacts 1, 2, 3, 4, 5, and 6 to be elastically and electrically contacted with the IC card 20, and an insulator 7 of a rectangular shape holding the contacts 1, 2, 3, 4, 5, and 6 fitted or assembled thereto by insert molding. The insulator 7 comprises a rectangular parallelepiped body generally extending in the first direction X and a second direction Y perpendicular to the first direction X and having a relatively small thickness in a third direction Z perpendicular to the first and the second directions X and Y. The insulator 7 serves to guide the IC card 20 so that the IC card 20 is inserted and removed in the first direction X and to receive the IC card 20.

The contacts 1, 2, 3, 4, 5, and 6 are similar in structure to one another. Herein, the contact 1 will be described as a representative. The contact 1 has a contacting portion 1*a* to be brought into contact with the IC card 20, a spring portion 1*b* having elasticity and extending from the contacting portion 1*a*, a frame portion 1*c* connected to an extending end of the spring portion 1*b*, and a terminal portion 1*d* extending from an outer peripheral part of the frame portion 1*c* to the outside of the frame portion 1*c*. The frame portion 1*c* defines a rectangular opening 1*e* extending in the first and the second directions X and Y.

The spring portion 1*b* extends from an inner peripheral part of the frame portion 1*c* to face the opening 1*e* in the third direction Z. Specifically, the spring portion 1*b* extends from the frame portion 1*c* to a direction intersecting the first and the third directions X and Z and is therefore separated from the insulator 7. The spring portion 1*b* has a width gradually increased from the contacting portion 1*a* towards the frame portion 1*c*.

The insulator 7 has an upper surface provided with a window 7*a* formed at a position corresponding to the contact 1. The window 7*a* has a shape such that a part of the frame portion 1*c*, i.e., a rim 1*f* surrounding the opening 1*e* is exposed together with the opening 1*e* through the window 7*a*. Thus, the opening 1*e* and the rim 1*f* are exposed on the upper surface of the connector 10 through the window 7*a*.

Since the rim 1*f* of the frame portion 1*c* is exposed through the window 7*a*, the rim 1*f* can be pressed through the window 7*a*. Therefore, during insert molding, the contact 1 can be properly positioned by pressing the rim 1*f*. Since the spring portion 1*b* need not be pressed, the degree of freedom in designing the shape of the spring portion 1*b* is increased.

The terminal portion 1*d* is exposed from an end face, i.e., a side surface of the insulator 7 in the second direction Y, bent towards the circuit board 13 in the third direction Z, and then bent outward to extend again in parallel to the circuit board 13. Thus, the terminal portion 1*d* has a stepped shape. The terminal portion 1*d* has a forward end which serves as a soldering portion 1*g* to be soldered to the circuit board 13.

The contacts 2, 3, 4, 5, and 6 have contacting portions 2*a*, 3*a*, 4*a*, 5*a*, and 6*a*, spring portions 2*b*, 3*b*, 4*b*, 5*b*, and 6*b*, frame portions 2*c*, 3*c*, 4*c*, 5*c*, and 6*c*, and terminal portions 2*d*, 3*d*, 4*d*, 5*d*, and 6*d* similar to the contacting portion 1*a*, the spring portion 1*b*, the frame portion 1*c*, and the terminal portion 1*d*, respectively. The frame portions 2*c*, 3*c*, 4*c*, 5*c*, and 6*c* define rectangular openings 2*e*, 3*e*, 4*e*, 5*e*, and 6*e* similar to the opening 1*e* of the frame portion 1*c*, respectively. On the other hand, the insulator 7 has rectangular windows 7*b*, 7*c*, 7*d*, 7*e*, and 7*f* similar to the window 7*a*. Therefore, the frame portions 2*c*, 3*c*, 4*c*, 5*c*, and 6*c* are partially exposed through the windows 7*b*, 7*c*, 7*d*, 7*e*, and 7*f*, respectively. The spring portions 1*b*, 2*b*, 3*b*, 4*b*, 5*b*, and 6*b* extend in directions coincident with one another, generally along the first direction X, namely, a direction in which the IC card 20 is inserted. More particularly, each of the spring portions 1*b*, 2*b*, 3*b*, 4*b*, 5*b*, and 6*b* extend to intersect the first and the third directions X and Z.

Like the terminal portion 1*d*, each of the terminal portions 2*d*, 3*d*, 4*d*, 5*d*, and 6*d* are exposed from the end face, i.e., the side surface of the insulator 7 in the second direction Y, bent towards the circuit board 13 in the third direction Z, and then bent outward to extend again in parallel to the circuit board 13. Thus, each of the terminal portions 2*d*, 3*d*, 4*d*, 5*d*, and 6*d* have a stepped shape. The terminal portions 2*d*, 3*d*, 4*d*, 5*d*, and 6*d* have forward ends which serve as soldering portions 2*g*, 3*g*, 4*g*, 5*g*, and 6*g* to be soldered to the circuit board 13.

Furthermore, the six contacts 1, 2, 3, 4, 5, and 6 are divided into first and second terminal arrays arranged along the second direction Y. The three contacts 1, 2, and 3 are included in the first terminal array. The terminal portion 1*d* of the contact 1 disposed at one end of the first terminal array is exposed from a first side surface 7*g* of the insulator 7. The terminal portion 3*d* of the contact 3 disposed at the other end is exposed from a second side surface 7*h* of the insulator 7. The terminal portion 2*d* of the contact 2 disposed at an intermediate position extends through an area between the first and the second terminal arrays to be exposed from the second side surface 7*h* of the insulator 7. On the other hand, the three contacts 4, 5, and 6 are included in the second terminal array. The terminal portion 4*d* of the contact 4 disposed at one end of the second terminal array is exposed from the first side surface 7*g* of the insulator 7. The terminal portion 6*d* of the contact 6 disposed at the other end is exposed from the second side surface 7*h* of the insulator 7. The terminal portion 5*d* of the contact 5 disposed at an intermediate position extends through the area between the first and the second terminal arrays to be exposed from the first side surface 7*g* of the insulator 7.

Thus, the terminal portions 1*d*, 2*d*, 3*d*, 4*d*, 5*d*, and 6*d* of the six contacts 1, 2, 3, 4, 5, and 6 are divided into the two terminal groups. One of the terminal groups is disposed at the first side surface 7*g* of the insulator 7 while the other terminal group is disposed at the second side surface 7*h* of the insulator 7. Thus, the terminal portions 1*d*, 4*d*, and 5*d* of the contacts 1, 4, and 5 extend in the second direction Y intersecting the inserting direction (first direction X) of the IC card 20 to be exposed on the first side surface 7*g*. The terminal portions 2*d*, 3*d*, and 6*d* of the contacts 2, 3, and 6 extend in the second direction Y to be exposed on the second side surface 7*h*. On the first side surface 7*g*, the terminal portions 1*d*, 4*d*, and 5*d* are positioned at different pitches. On the second side surface 7*h*, the terminal portions 2*d*, 3*d*, and 6*d* are positioned at different pitches. On the first and the second side surfaces 7*g* and 7*h*, the terminal portions are disposed at corresponding positions at same pitches.

As described above, the soldering portions 1*g*, 2*g*, 3*g*, 4*g*, 5*g*, and 6*g* of the contacts 1, 2, 3, 4, 5, and 6 are disposed on the first and the second side surfaces 7*g* and 7*h* of the insulator 7. Therefore, these soldering portions serves to make the card connector 10 have a polarity known in the art. Specifically, by positioning the terminal portions 1*d*, 2*d*, 3*d*, 4*d*, 5*d*, and 6*d* in recessed portions 12*a*, 12*b*, 12*c*, and 12*d* of a housing 12, it is possible to define the orientation of the card connector 10. Therefore, it is unnecessary to provide the insulator 7 with a recess or a protrusion in order to provide the polarity. Since the polarity can be judged by the pitches of the soldering portions 1*g*, 2*g*, 3*g*, 4*g*, 5*g*, and 6*g*, the size of the card connector 10 can be reduced correspondingly.

Furthermore, by soldering the soldering portions 1*g*, 2*g*, 3*g*, 4*g*, 5*g*, and 6*g* to the circuit board 13, the card connector 10 can be reinforced or strengthened. Therefore, even if the card connector 10 is increased in size in the first direction X, no problem will arise in view of the mechanical strength.

The IC card 20 has six contact points on one surface or a lower surface thereof. In order to connect the IC card 20, the IC card 20 is moved from right to left as depicted by an arrow 21 in FIGS. 2 and 4 and mounted on the upper surface of the card connector 10. When the IC card 20 is mounted at a predetermined position on the upper surface of the card connector 10, the six contact points of the IC card 20 are brought into contact with the contacting portions 1*a*, 2*a*, 3*a*, 4*a*, 5*a*, and 6*a* of the contacts 1, 2, 3, 4, 5, and 6, respectively. As a result, the IC card 20 is electrically connected to the card connector 10.

The above-mentioned card connector 10 is fitted into the insulating housing 12 and mounted on the circuit board 13. The soldering portions 1*g*, 2*g*, 3*g*, 4*g*, 5*g*, and 6*g* of the contacts 1, 2, 3, 4, 5, and 6 are connected to an electrical circuit of the circuit board 13 by soldering.

Figure 4:
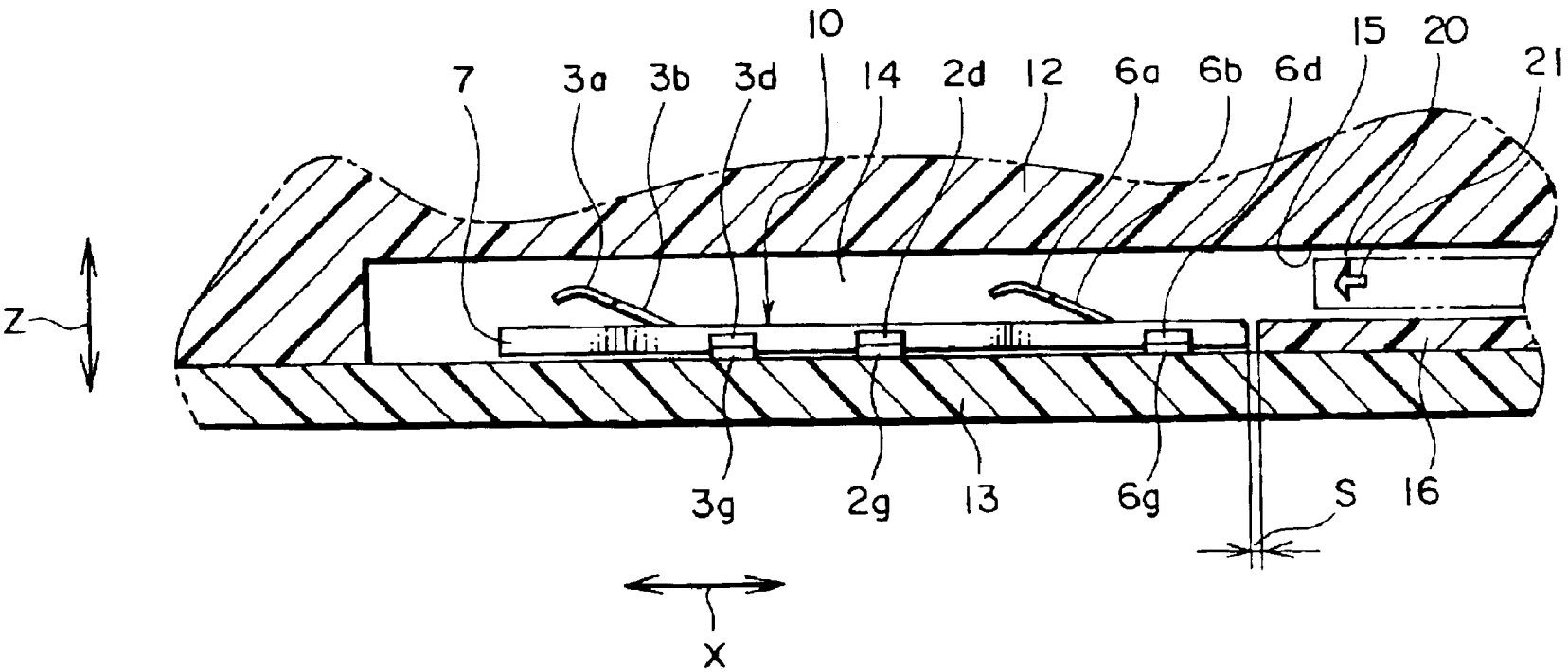
FIG. 4 is a sectional side view of the connector illustrated in FIG. 3.

The housing 12 defines a cavity 14 to position the IC card 20 above the card connector 10, and a card guide hole 15 for guiding the IC card 20 to be inserted and removed. In order to prevent the IC card 20 inserted through the card guide hole 15 from being engaged with the insulator 7, a card guide plate 16 substantially same in thickness to the insulator 7 is fixed to the circuit board 13 or the housing 12. Since the terminal portions 1*d*, 2*d*, 3*d*, 4*d*, 5*d*, and 6*d* of the contacts 1, 2, 3, 4, 5, and 6 are not present on the end face of the insulator 7 in the inserting direction of the IC card 20, the card guide plate 16 can be arranged closely adjacent to the insulator 7 so that a gap S in FIG. 4 is minimized to be substantially equal to zero. With this structure, it is possible to prevent the IC card 20 from being engaged with the insulator 7 when the IC card 20 is inserted.

Figure 5:
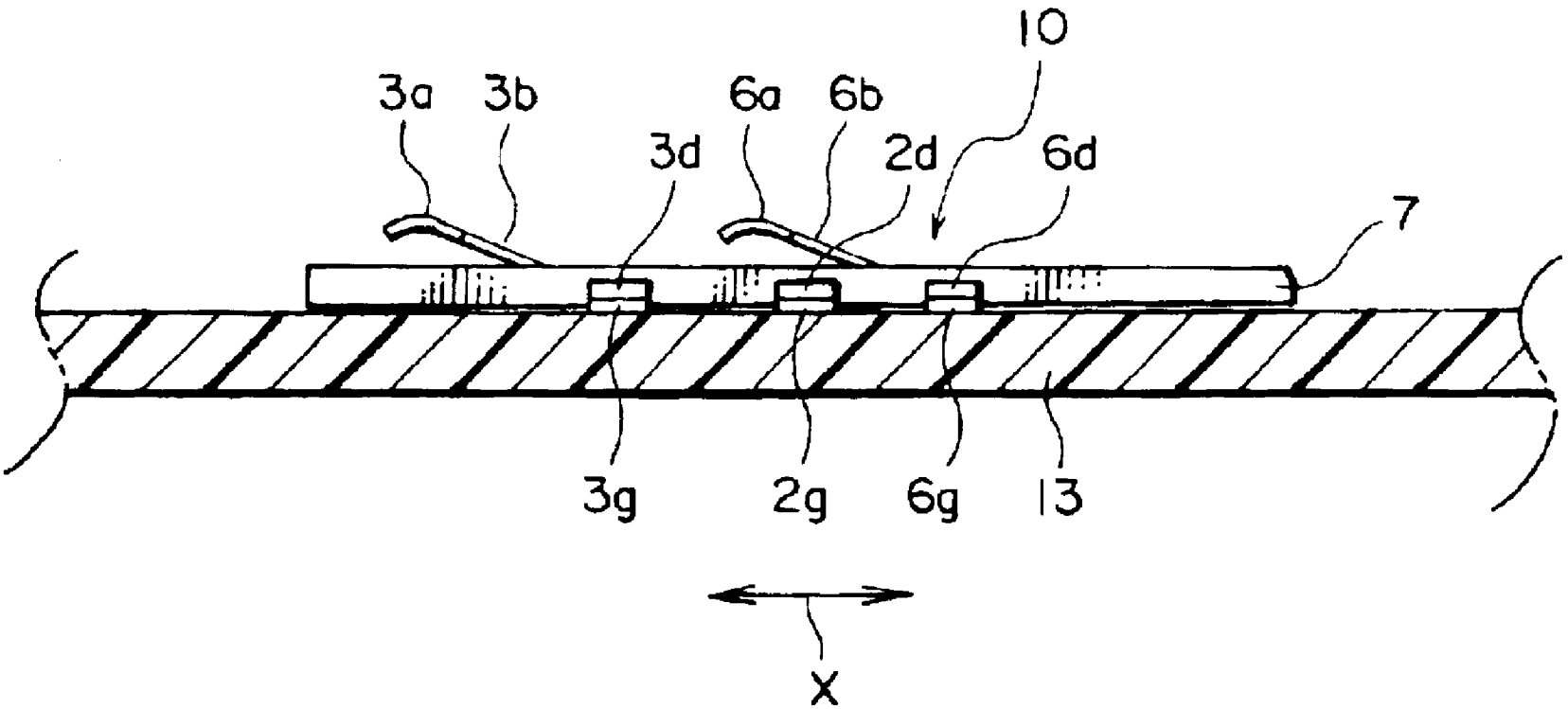
FIG. 5 is a sectional side view of a connector according to another embodiment of the present invention when it is received in a housing.

Referring to FIG. 5, the description will be made as regards a card connector according to another embodiment of the present invention. Similar parts are designated by like reference symbols.

In the card connector 10 of FIG. 5, the terminal portions 2*d*, 3*d*, and 6*d* of the contacts 2, 3, and 6 are concentrically disposed in a substantial center area of the second side surface 7*h* of the insulator 7 in the first direction X. Similarly, the terminal portions 1*d*, 4*d*, and 5*d* of the contacts 1, 4, and 5 are concentrically disposed in a substantial center area of the first surface 7*g* of the insulator 7 in the first direction X. With this structure, the card connector 10 is sufficiently reinforced or strengthened by soldering the soldering portions 1*g*, 2*g*, 3*g*, 4*g*, 5*g*, and 6*g* to the circuit board 13.

While the present invention has thus far been described in connection with a few embodiments thereof, it will readily be possible for those skilled in the art to put this invention into practice in various other manners. For example, although the description has been made as regards the card connector having the six contacts, the number of the contacts is not restricted thereto but may be modified in various manners.

What is claimed is:

1. A connector comprising an insulator for receiving a first object to be movable in a first direction and a conductive contact coupled to said insulator, said conductive contact comprising:

a frame portion fixed to said insulator and defining an opening extending in said first direction and a second direction perpendicular to said first direction;

a spring portion extending from said frame portion in said first direction to face said opening in a third direction perpendicular to said first and said second directions, said spring portion being substantially surrounded by said frame portion;

a contacting portion connected to said spring portion for contacting with said first object; and a terminal portion extending from said frame portion to an outside of said frame portion for contacting with a second object, said terminal portion having a part which is exposed outward from said insulator in said second direction.

2. A connector according to claim 1, wherein said frame portion is fixed to said insulator by insert molding.

3. A connector according to claim 2, wherein said insulator has a shape to expose said opening and a part of said frame portion which surrounds said opening.

4. A connector according to claim 1, wherein said spring portion is separated from said insulator in said third direction.

5. A connector according to claim 4, wherein said spring portion extends in a direction intersecting said first and said third directions.

6. A connector according to claim 5, wherein said spring portion has a width greater in a part adjacent to said frame portion than in a remaining part of said spring portion.

7. A connector according to claim 1, wherein said terminal portion is fixed to a substantial center area of said insulator in said first direction.

8. A connector according to claim 1, wherein said first object is an IC card while said second object is a circuit board.

9. A connector comprising an insulator for receiving a first object to be removable in a first direction and six conductive contacts coupled to said insulator, each of said conductive contacts comprising:

a frame portion fixed to said insulator and defining an opening extending in said first direction and a second direction perpendicular to said first direction;

a spring portion extending from said frame portion in said first direction to face said opening in a third direction perpendicular to said first and said second directions, said spring portion being substantially surrounded by said frame portion;

a contacting portion connected to said spring portion for contacting with said first object; and a terminal portion extending from said frame portion to an outside of said frame portion for contacting with a second object, said terminal portion having a part which is exposed outward from said insulator in said second direction.

10. A connector according to claim 9, wherein said frame portion is fixed to said insulator by insert molding.

11. A connector according to claim 10, wherein said insulator has a shape to expose said opening and a part of said frame portion which surrounds said opening.

12. A connector according to claim 9, wherein said spring portion is separated from said insulator in said third direction.

13. A connector according to claim 12, wherein said spring portion extends in a direction intersecting said first and said third directions.

14. A connector according to claim 13, wherein said spring portion has a width greater in a part adjacent to said frame portion than in a remaining part of said spring portion.

15. A connector according to claim 9, wherein said terminal portions of said six contacts are placed collectively to a substantial center area of said insulator in said first direction.

16. A connector according to claim 9, wherein said insulator has a pair of said surfaces extending in said first and said third direction, said terminal portions of said six contacts being divided into two terminal groups, said two terminal groups being disposed on said side surfaces, respectively.

17. A connector according to claim 9, wherein said six contacts are divided into two terminal groups arranged along said second direction, each of said terminal groups having three contacts including an intermediate one in said second direction, the terminal portion of said intermediate contact extending through an area between said two terminal groups.

18. A connector according to claim 9, wherein said first object is an IC card while said second object is a circuit board.

* * * * *